United States Patent [19]

Ten Wolde

[11] Patent Number: 4,952,432

[45] Date of Patent: Aug. 28, 1990

[54] ZIGZAG FOLDED TOWEL PACKET FOR USE WITH TOWEL DISPENSING APPARATUS

[75] Inventor: A. W. Ten Wolde, Bentveld, Netherlands

[73] Assignee: Vendor Holding B.V., Netherlands

[21] Appl. No.: 404,267

[22] Filed: Oct. 10, 1989

Related U.S. Application Data

[60] Division of Ser. No. 341,291, Apr. 19, 1989, which is a continuation-in-part of Ser. No. 20,707, Mar. 2, 1987, abandoned, which is a division of Ser. No. 741,704, Jun. 5, 1985, abandoned, which is a continuation of Ser. No. 534,600, Sep. 22, 1983, abandoned.

[30] Foreign Application Priority Data

Sep. 24, 1982 [NL] Netherlands ..... 8203720

[51] Int. Cl.[5] ..... B32B 7/06; B32B 7/12

[52] U.S. Cl. ..... 428/40; 428/126

[58] Field of Search ..... 428/40, 126

[56] References Cited

U.S. PATENT DOCUMENTS 3,001,735 9/1961 Francik ..... 428/43

*Primary Examiner*—Alexander S. Thomas

*Attorney, Agent, or Firm*—Andrus, Sceales Starke & Sawall

[57] ABSTRACT

A packet of toweling for single use adapted to be dispensed for hand drying from an apparatus having a supply chamber from which the toweling is manually withdrawn for use and a storage roller operable in response to the withdrawal of toweling to roll up and store the used web toweling, said packet comprising a zigzag folded, continuous web of paper material extending between first and second web ends, said paper material having a reinforcement comprising a fabric of synthetic threads for providing said web with a tensile strength sufficient to prevent tearing during withdrawal, use and rolling up, said web having an adhesive area of the exposed surface adjacent one of said ends by which an additional, similar packet may be joined to said packet, said adhesive area having a removable cover. In a preferred embodiment, the removable paper cover (30) of the adhesive area comprising a first surface portion (33) having a low adhesive coating in contact with the adhesive area and an integral pull tab (31) extending beyond one vertical face of said packet and adapted to permit said paper cover (30) to be pulled out from between this packet (11) and a similar packet (11) disposed with the other of its said ends in contact therewith.

5 Claims, 2 Drawing Sheets

ZIGZAG FOLDED TOWEL PACKET FOR USE WITH TOWEL DISPENSING APPARATUS

This is a divisional of Ser. No. 07/341,291, filed Apr. 19, 1989, which is a continuation-in-part of application Ser. No. 07/020,707, filed Mar. 2, 1987, abandoned, which is a divisional of Ser. No. 741,704, filed June 5, 1985, abandoned, which is a continuation of Ser. No. 534,600, filed Sept. 22, 1983, abandoned.

This invention relates to an apparatus for dispensing a continuous web of product, particularly adapted for hygienic use, such as towels, which apparatus is provided with a body having a supply chamber for one or more standard packets of a zigzag folded, continuous, web of unused product, of which a towel length can be brought from the supply chamber into a dispensing space, which is accessible from the outside of the body for drying of, for instance, the hands, after which the lastly used towel length is removed from the dispensing space.

Apparatuses of the type described above are known from the document U.S. Pat. No. 2.809.082 and are specially used in spaces, such as lavatories, wash and changing rooms etc. The zigzag folded web of product comprises paper, of which the user can draw a towel length each time from the packet, tear it off and use it.

These known apparatus have the objection, that the used towels have to be thrown by the users into a bin or basket, which is emptied by special service personnel. As this service personnel usually works at night, whereas the user use the towels especially during the day but also at other times, there are sometimes periods during the day or during the night, in which the users find an overflowing bin or basket, so that these towels get on to the floor. This situation is unhygienic and therefore undesirable.

The object of the invention is removing these objections and providing a dispensing apparatus, in which the used towels are always cleaned up by rolling up and can be removed quicky as a roll, without the users having to perform any operations themselves.

This object is attained according to the invention, in that in the body rolling up means, means are present for storing the used part of the web of product.

By application of the invention it is accomplished that in the body starting from packets of zigzag folded, continuous web, unused product rolls of used product can be formed, which can be removed quickly by service personnel.

The invention also relates to a packet of product, especially adapted for hygienic use, such as towels, which continuous product web is zigzag folded to a packet. If this packet is formed out of paper having a tensile strength, which could lead to undesired tearing off, according to another embodiment of the invention a reinforcement is applied, which comprises, for example, synthetic material, such as a fabric or fleece of filaments, or a thin layer or film of synthetic material which is provided with perforations.

According to another embodiment of the invention the outer end layers of the packet of product are provided with coupling means, which are adapted to be coupled to the counter coupling means of a similar packet.

According to yet another embodiment of the invention the coupling means comprises a two sided adhesive strip with a removable cover strip on the side that is to be coupled with the counter coupling means.

This has the result, that the packet which is being used does not need to be completely used up before the beginning layer of the next packet can be brought into the dispensing position. Thus a regular lengthening of the web is possible within a frequency and an amount of unused product that is variable between wide limits. Thereby the supply chamber can contain continuously a greater average working supply of unused product, without the danger existing that the whole supply will be used up. This guarantees, tha the user can get always a length of unused towel.

The invention will now further be elucidated referring to the accompanying schematic drawing wherein, FIG. 1 shows a vertical cross section of a dispensing apparatus according to the present invention.

Figure 1:
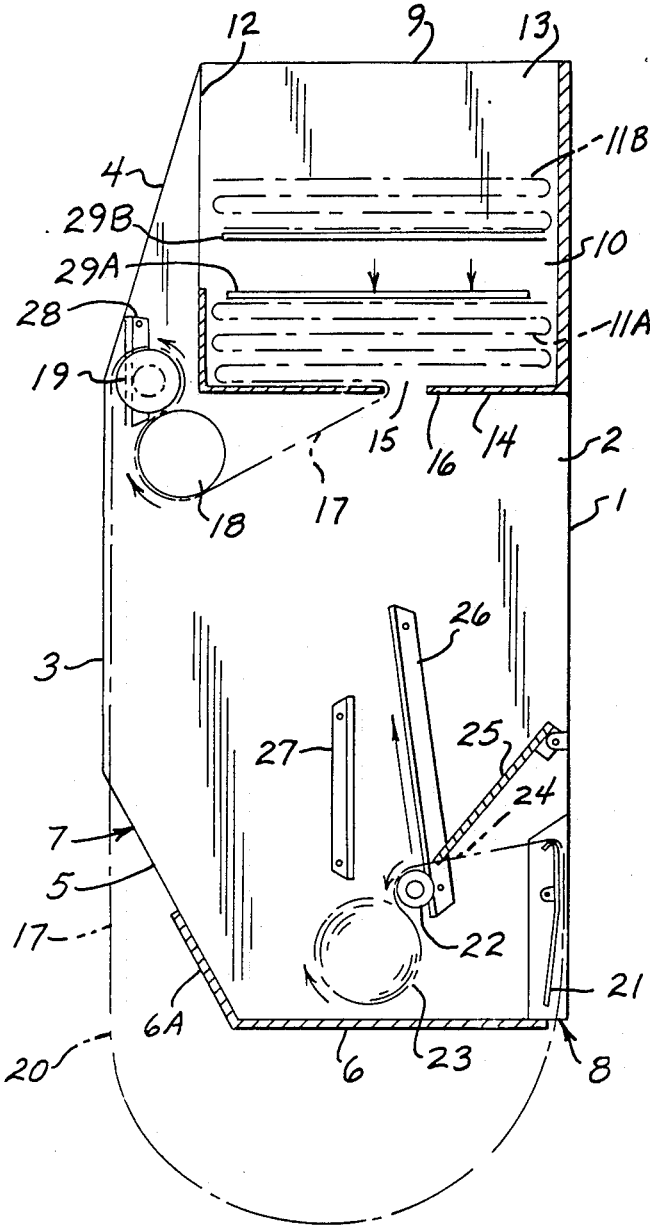

In the drawing an embodiment is shown of an apparatus for dispensing a web of product, particularly adapted for hygenic use, such as towels, and is adapted for placing in a lavatory, washing or changing room and such. The apparatus comprises a body that is partly enclosed by a (non shown) removable hood. The body has a back wall 1, with which the apparatus can be hung on a (non shown) wall of for instance a lavatory space at substantially the average shoulder height. Furthermore the body comprises two side walls, of which only the back lying side wall 2 is visible. On the front side the side wall 2 has a substantially vertical front edge 3, which has on the upper and lower side a prefeably backward sloping part 4 and 5 respectively. The lower side of the body is provided with a bottom 6, which has a strip 6A that slopes upwardly according to the front edge part 5. Between the end edge of this bottom part 6A and the front edge 3 an opening 7 is left free. On the back side of the body between the back wall of the bottom 5 and the lower edge of the back wall 1 the opening 8 is left free.

On the upper side of the body between the upper edge of the back wall 1 and the backwardly sloping front edge part 4 the opening 9 is left free. This opening 9 gives access to the supply chamber 10 for unused or clean product, which is in the form of one or more packets 11A, 11B, etc. The cross section of the opening 9 to the supply chamber 10 is at least as great as the cross ection of this supply chamber. This supply chamber 10 is formed by the front wall 12, side walls of which only one side wall 13 is visible in the drawing, and the bottom 14. This bottom 14 is provided with an outlet slit 15, which is located rearwardly of the centerline of the bottom 14 and which runs along substantially the entire length of the supply chamber. This outlet slit 15 is yet provided with an outlet funnel 16 for guiding the web of product 17.

The web of product 11A, that rests on the lower side of the supply chamber 10 on the bottom 14, a zigzag folded web of product. From the lower side of this product 17 runs through the slit 15 to the lower side of the guide roll 18, along this upwardly and to the upper lying guide roll 19, in order to run subsequently downward behind the (non shown) hood and the front edge 3. The product web 17 leaves the front side of the house through the opening 7 and forms a downwardly pending loop 20 in the dispensing space and enters again at the back side via the opening 8.

Above the opening 8 the web 20 runs between a guide plate 21, which flattens the possibly creased material, and the back wall 1, in order to be guided over the rounded, upper side of the guide plate 21 to the pressure roll 22. This pressure roll 22 presses against the roll 23, on which the used product 20 is collected into a roll. The part 24 between the upper side of the guide plate 21 and the pressure roll 2 is kept pressed against the pressure roll 22 by means of the guide plate 25, which is pivotally fastened above the guide plate 21 to the inside of the back wall 1 and keeps the part 24 taut. Thus no return of the product web is possible and transverse web deviations are encountered. In order to be able to adapt to the variable sizes of the used maerial roll 23 the pressure roll is furthermore movable in a slanting upward and downward direction in the guides 26, which are fastened to the side wall of the body. Furthermore the guide 27 ensures that the web 24 cannot get any transverse deviations.

The guide roll 19 on the upper side of the apparatus is also vertically movable in the guide 28.

The upper side of the product packet 11A is provided with a two sided adhesive strip 29, as is the lower side of the upper lying packet 11B. By removing the cover strip from the adhesive outside of this adhesive strip and pressing both packets together, the coupling between the upper lying end layer of the underlying packet 11A and the underlying beginning aver of the upper lying packet 11B is formed. It is thereby accomplished that the user always gets an uninterrupted supply of unused or clean product 17.

Figure 2:
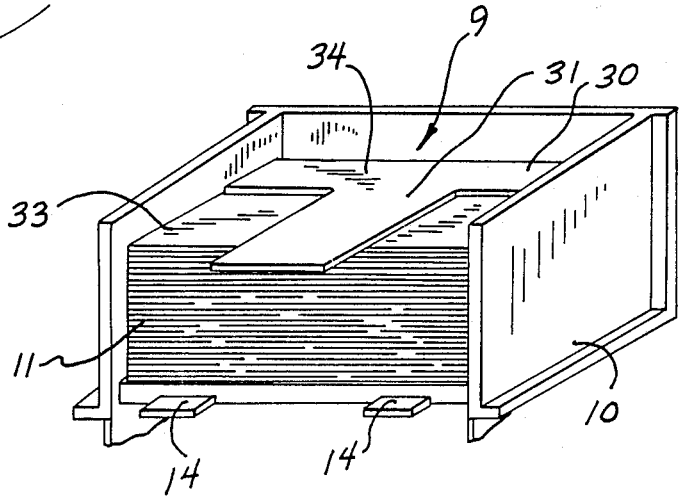
FIG. 2 is a perspective view showing the interior of the supply chamber of the dispensing apparatus shown in FIG. 1 including the towel packet usable therein.
Figure 3:
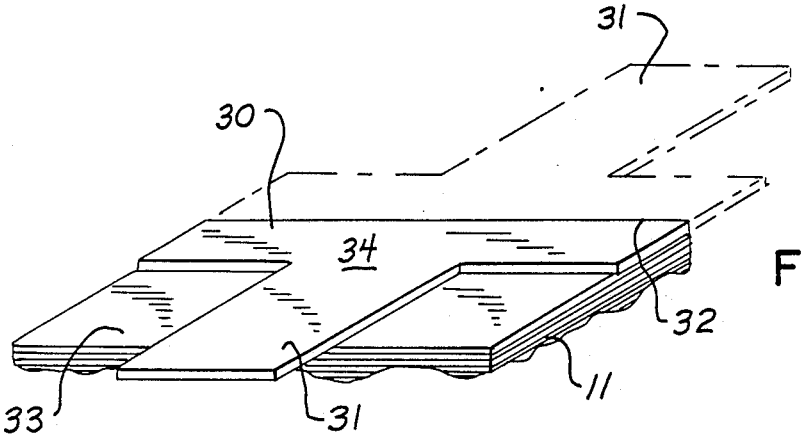
FIG. 3 is a perspective view of a removable paper cover used on the towel packet shown in FIG. 2.

Referring also to FIGS. 2 and 3, in a preferred embodiment, the upper surface of the end fold of every packet 11 of toweling product 17 is provided with a layer or band of a suitable adhesive. The adhesive may be applied by means of a hot melt appicator (not shown) or any other suitable means. A T-shaped release paper cover 30 is placed over the adhesive layer on the top fold of the packet 11 to be temporarily secured thereto. The cover 30 is folded back upon itself about a fold line 32 such that a lower first surface portion 33 overlies and is in contact with the adhesive layer. The upper folded portion 34 includes the pull tab 31 which extends outwardly beyond the vertical front face of the packet 11. The fold line is disposed to lie along the rear edge of the paper cover 30 farthest from the vertical front face of the packet. After a similar packet 11 is inserted into the opening 9 of the supply chamber 10, the pull tab 31 is grasped by hand and slowly pulled out, so that the cover 30 is stripped from the adhesive on the top fold of the lower packet 11, beginning at the fold line 32 at the rear edge and proceeding forwardly. The uncovered glue layer then attaches directly to the bottom fold of the similar refill packet 11 lying thereover thereby providing a connection for a continuous web of product 17. The adhesive connection may be enhanced by simply pressing the upper packet 11 downwardly against the lower. The underside of the lower first surface portion 33 of the cover 30 is preferably coated with a release agent to facilitate its stripping from the adhesive layer. A preferred release agent comprises a silicone coating.

After this product 17 has moved into the loop 20 and is in this place used for drying the hands, the product is rolled up into the roll 23 which is interconnected with roll 18 so that rotation of roll 18 causes a rotation of roll 23. When this roll 23 has reached suitable dimensions it can be removed from the apparatus via opening or removable bottom 6 by the service personnel. The service personnel can then also add through the inlet opening 9 one or more additional packets 11 and couple these to the already present packet. The inlet opening 9 can suitably be provided with a (non shown) removable lid or be crossed off by the (non shown) hood.

A web of product paper can be used that is reinforced with a fabric or fleece of synthetic material. It is however also possible to use a textile fabric of natural or synthetic fibres or mixtures thereof. When a web of product paper has been used, the collected roll 23 will normally be thrown away. When textile material is used, this in most cases can be reused after washing.

Figure 4:
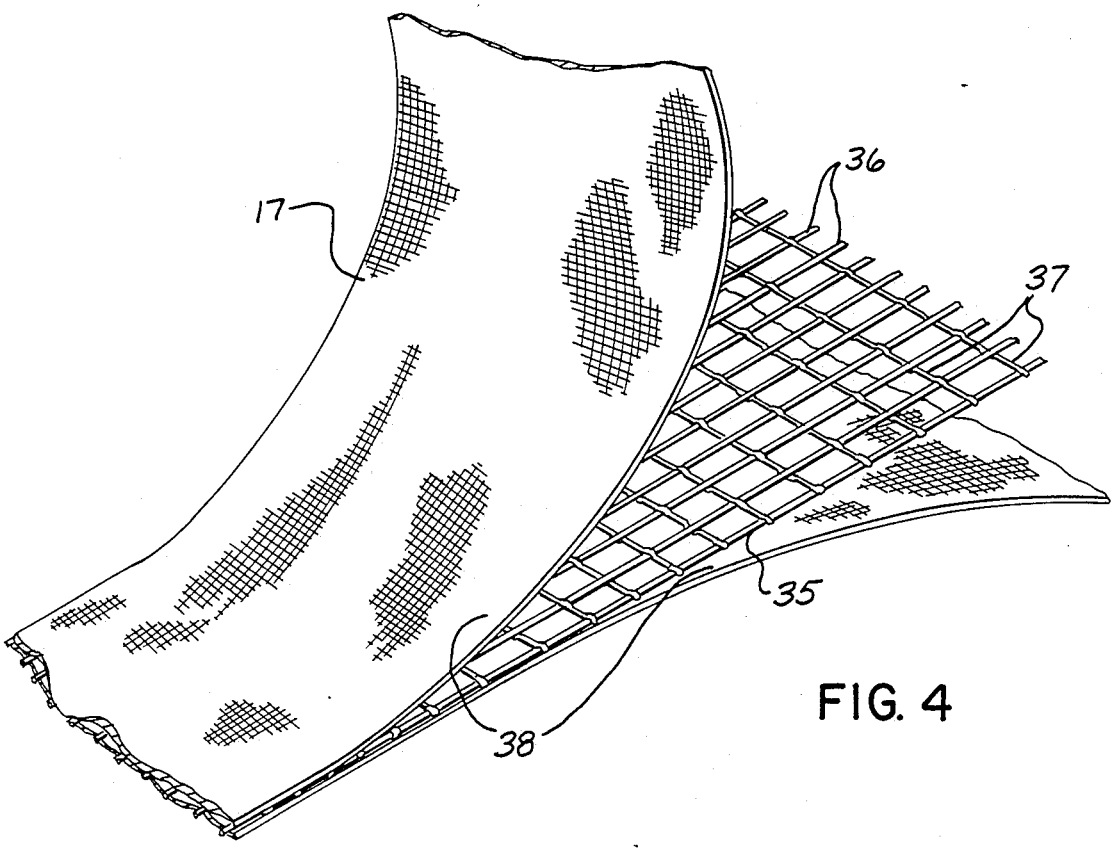
FIG. 4 is a perspective view showing the construction of a preferred embodiment of the reinforced paper towel used in the present invention.

Referring to FIG. 4, a preferred embodiment of the reinforced paper web 17 includes a reinforcing fabric 35 of synthetic threads, such as polyester, disposed in a grid-like pattern comprising longitudinally extending threads 36 and traversely extending threads 37. The grid-like pattern of reinforcement provides strength in all directions in the plane of the web 17 to provide a tensile strength which is sufficient to prevent tearing during manual withdrawal of the web from the dispenser, during use in drying the hands, and when subsequently automatically rolled up on the storage roller. The web 17 is preferably formed by placing the synthetic fabric 35 between two layers of tissue paper 38 and running the laminate of paper and fabric between the nip of a pair of heating and pressurizing rolls (not shown). The synthetic fabric 35 is preferably made with a more closely spaced pattern of longitudinally extending threads 36 and fewer or less closely spaced transversely extending threads 37. Also, the longitudinally extending threads 36 may be of a slightly larger section and, therefore, individually stronger than the threads 37. For example, the fabric may comprise a pattern of 3 longitudinal threads per centimeter of web width and 0.8 transverse threads per centimeter of web length. In one preferred embodiment, the threads 36 are of one 167 Detex and the threads 37 are of 140 Detex. The resulting tensile strength of the fabric is more than four times greater in the longitudinal direction than in the transverse direction.

The operation of the apparatus is as follows: the user pulls with both hands on the web 17, where this leaves the opening 7 of the body and obtains a length of clean unused towel 20. As the rolls 18 and 23 are rotatably inter connected by (non shown) means, the used, dirty web 20 is automatically rolled up on the roll 23 by this pulling. Furthermore (non shown) adjustable means are present for adjusting the length of the towel and blocking a new dispensing during an adjustable time period after the last dispensing.

I claim:

1. A packet of toweling adapted to be dispensed for hand drying from an apparatus having a supply chamber from which the toweling is manually withdrawn for use and a storage roller operable in response to the withdrawal of toweling to roll up and store the used wet toweling, said package comprising a zigzag folded, continuous web of paper material extending between first and second web ends, said paper material having a reinforcement for providing said web with a tensil strength sufficient to prevent tearing during withdrawal, use and rolling up, said web having an adhesive area on the surface adjacent one of said ends by which an additional, similar packet may be joined to said packet, said adhesive area having a removable paper cover comprising a first surface portion having a low adhesive coating in contact with the adhesive area and an integral pull tab extending beyond one vertical face of said packet and adapted to permit said paper cover to be pulled out from between said packet and said similar packet disposed with the other of its said ends in contact therewith.

2. The invention as set forth in claim 1 wherein said first surface portion of said paper cover overlies substantially the entire adhesive area.

3. The invention as set forth in claim 2 wherein said pull tab comprises a folded portion of said cover extending from a fold line between said tab and said first surface portion said fold line lying along the edge of said cover farthest from said one vertical face.

4. The invention as set forth in claim 3 wherein the low adhesive coating on said first surface portion comprises a release agent.

5. The invention as set forth in claim 4 wherein said release agent comprises a coating of silicone.

* * * * *